US009759207B2

(12) United States Patent
Chou

(10) Patent No.: US 9,759,207 B2
(45) Date of Patent: Sep. 12, 2017

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 285 days.

(21) Appl. No.: 14/664,387

(22) Filed: Mar. 20, 2015

(65) Prior Publication Data

US 2015/0285236 A1 Oct. 8, 2015

(30) Foreign Application Priority Data

Apr. 7, 2014 (TW) ..... 103112755 A

(51) Int. Cl.

| | |
|---|---|
| ***F04B 35/04*** | (2006.01) |
| ***F04B 39/06*** | (2006.01) |
| ***F04B 39/12*** | (2006.01) |
| ***F04B 39/14*** | (2006.01) |
| ***F04B 53/08*** | (2006.01) |

(52) U.S. Cl.

CPC ..... *F04B 39/066* (2013.01); *F04B 35/04* (2013.01); *F04B 39/121* (2013.01); *F04B 39/125* (2013.01); *F04B 39/127* (2013.01); *F04B 39/14* (2013.01); *F04B 53/08* (2013.01); *F05C 2225/00* (2013.01)

(58) Field of Classification Search

CPC ..... F04B 35/04
USPC ..... 417/360, 415
See application file for complete search history.

(56) References Cited

U.S. PATENT DOCUMENTS

| | | | | |
|---|---|---|---|---|
| 4,957,419 | A * | 9/1990 | Rascov | F04B 19/022 417/273 |
| 5,836,747 | A * | 11/1998 | Gondek | A23G 3/0221 417/470 |
| 6,135,725 | A * | 10/2000 | Chou | F04B 35/04 417/360 |
| 7,240,642 | B2 * | 7/2007 | Chou | F04B 39/123 123/41.35 |
| 2008/0240943 | A1 * | 10/2008 | Wang | F04B 35/01 417/361 |
| 2010/0001100 | A1 * | 1/2010 | Fontaine | B05B 9/0877 239/331 |
| 2013/0011283 | A1 * | 1/2013 | Chou | F04B 35/04 417/437 |

* cited by examiner

*Primary Examiner* — Patrick Hamo

(57) ABSTRACT

An air compressor includes an air storage container, a cylinder fitted with a piston body and a main frame for mounting a motor. The cylinder and the main frame are integrally formed of plastic. The air storage container is detachably mounted to the cylinder. The main frame is provided with though holes for guiding the air flow, generated by a cooling fan, to flow through the main frame. The main frame is formed with two lateral walls and a bottom wall to form a U-shaped wind collecting shell. The second portion of the main frame is held by multiple radial braces, which facilitates the air flow being introduced through the main frame for rapidly dissipating the heat generated from the reciprocating motion of the piston body, so that the operational security can be increased. The non-metal air compressor may lead to a reduction of the manufacturing cost and the weight.

9 Claims, 24 Drawing Sheets

AIR COMPRESSOR

TECHNICAL FIELD OF THE INVENTION

The present invention relates to an air compressor and, more particularly, to an air compressor that includes an air storage container, a cylinder, and a main frame for mounting a motor, wherein the air storage container, the cylinder, and the main frame are made of plastic, the cylinder is formed integrally with the main frame, and the air storage container is detachably mounted to the cylinder.

DESCRIPTION OF THE PRIOR ART

Generally, an air compressor employs a motor to drive a piston to conduct reciprocating motion within a cylinder for producing compressed air in the cylinder. The compressed air can be transferred to an air storage container, which is usually provided with one or more outlets. Functional elements, such as safety valve and relief valve, can be installed at the outlets. Alternatively, a connecting means, such a hose can be connected to one outlet to allow the compressed air within the storage container to be delivered to an application object, such as a tire.

Although conventional air compressors, which are made of metal, would not cause deformation on the cylinder when it is subject to the heat generated from the reciprocating motion of the piston, the manufacturing cost is high. Another disadvantage of conventional air compressors is that the sealing means, such as a valve plug or a resilient sheet, disposed between the air storage container and the cylinder is prone to lose its original sealing function after they have been used for a period of time. For this reason, the air compressing function of conventional air compressors cannot be well maintained.

The applicant has been dedicated to developing air compressors for a long time. At the early days, the applicant successfully converted a complicated air compressor into an air compressor that is simple in structure and can be quickly assembled. The applicant also has successfully modified an air compressor that was originally poor in performance. In view of the disadvantages of conventional air compressors, based on long-term experiences of related compressor products, the applicant has contrived an advanced air compressor that can provide a better sealing effect between the air storage container and the cylinder. In addition, the manufacturing cost and the weight of the air compressor can be reduced.

SUMMARY OF THE INVENTION

One object of the present invention is to provide an air compressor, that includes a cylinder fitted with a piston and a main frame for mounting a motor, wherein the cylinder and the main frame are integrally formed of plastic, and the main frame is provided with one or more through holes for guiding the air flow, generated by a cooling fan, to flow through the main frame. The main frame is formed with two lateral walls and a bottom wall to form a U-shaped wind collecting shell, wherein the second portion of the main frame is held by multiple radial braces, which facilitates the air flow being introduced through the main frame for rapidly dissipating the heat of the bearing generated from the reciprocating motion of the piston body, so that the operational security can be increased. Furthermore, the air compressor made of non-metal may lead to a reduction of the manufacturing cost.

Another object of the present invention is to provide an air compressor, wherein the air storage container is detachably mounted to the cylinder.

A further object of the present invention is to provide an air compressor, wherein the open bottom of the cylinder is divided into two halves according to a central vertical line of the cylinder, wherein one half of the open bottom is horizontal while the other half of the open bottom is slanted A still further object of the present invention is to provide an air compressor, wherein a first tubular projection is formed on the top wall of the cylinder, and a second tubular projection having a diameter less than the first tubular projection is formed on the first tubular projection. The first tubular projection defines a first annular groove around its circumference to be fitted with a first seal ring. A first top annular surface is formed on the first tubular projection around the second tubular projection. The second tubular projection is flared at its top, on which a second top annular surface with an outer edge is formed, thus defining a second annular groove between the outer edge and the first top annular surface to be snugly fitted with a second seal ring. The second seal ring has a cross-section diameter greater than the distance between the outer edge and the first top annular surface, so that the second seal ring slightly projects above the second top annular surface when the second seal ring is not subject to a compressive force or when the second seal ring is subject to a lower level of compressive force. The first tubular projection and the second tubular projection define a bore that communicates the inner space of the cylinder with the inner space of the air storage container. A compression spring is used to force a sealing means, such as a valve plug or a resilient sheet, against the second seal ring to seal the bore defined by the first and second tubular projections. Particularly, the compression spring has sufficient elasticity to force the sealing means against the second seal ring and the second top annular surface of the second tubular projection, whereby the bore defined by the first and second tubular projections can be sealed more securely.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
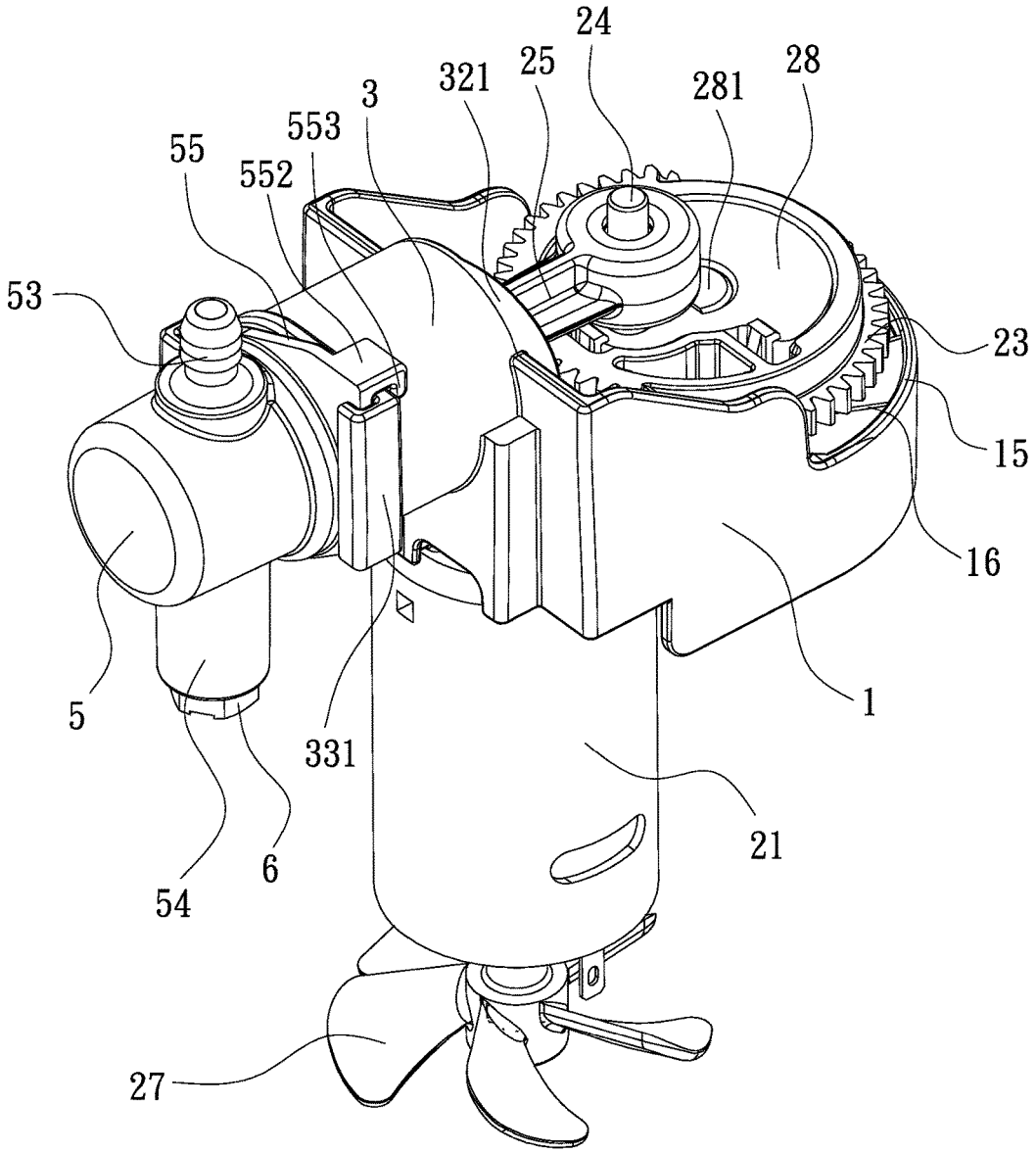
FIG. 1 shows a 3-dimensional view of an air compressor according to a first embodiment of the present invention.
Figure 2:
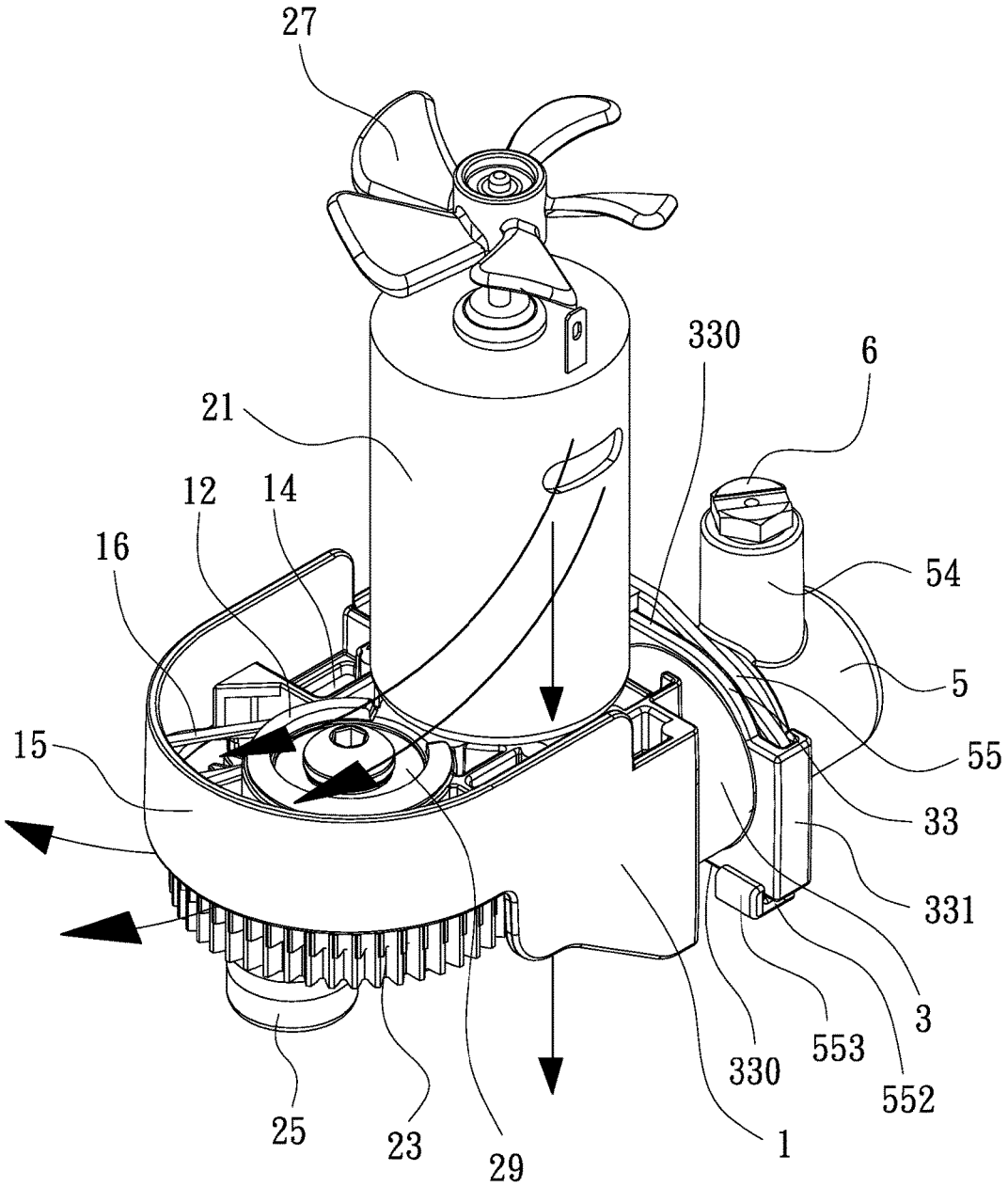
FIG. 2 shows a 3-dimensional view of the air compressor of the first embodiment of the present invention, which is viewed from a different direction.

Referring first to FIGS. 1 through 5, an air compressor according to a first embodiment of the present invention is shown, wherein a cylinder 3 is fitted with a piston body 25 having a piston head 26, a main frame 1 is used for mounting a motor 21 that can drive the piston body 25 to conduct reciprocating motion within the cylinder 3. In particular, the cylinder 3 and the main frame 1 are integrally formed of plastic. The main frame 1 has a first portion 11 and a second portion 12 (see FIG. 5). The first portion 11 mounts the motor 21 that is fitted with a small gear 22 at one end and a cooling fan 27 at the other end. The second portion 12 fixes a bearing 29 in place. The large gear 23 is provided with a counterweight 28 being fixed with a crankpin 24. A crankshaft 281 is fixed at one end to the counterweight 28 and mounted at the other end to the bearing 29. The piston body 25 is pivotally mounted to the crankpin 24. The large gear 23 are mounted to the main frame 1 such that the small gear 22 engages with the large gear 23. The main frame 1 defines two through holes 13, 14 at two sides of the first and second portions 11, 12 for guiding the air flow, generated by the cooling fan 27, to flow through the main frame 1. The main frame 1 is formed with two lateral walls and a bottom wall to form a U-shaped wind collecting shell 15, wherein the second portion 12 is located within the U-shaped wind collecting shell 15 and held by multiple radial braces 16 formed between the second portion 12 and the U-shaped wind collecting shell 15. The radial braces 16 facilitate the air flow, generated by the cooling fan 27, being introduced through the main frame 1 for rapidly dissipating the heat of the bearing 29 generated from the reciprocating motion of the piston body 25 within the cylinder 3, thereby increasing the operational security. The motor 21 can drive the crankpin 24 to swing in a circle around the crankshaft 281, so that the piston body 25 can conduct reciprocating motion within the cylinder 3 to produce compressed air in the inner space 34 of the cylinder 3. The compressed air can move a valve plug 41, which is used as a sealing means, upwardly so that it can pass a through hole 30 to flow into the air storage container 5. The air storage container 5 is integrally formed with two outlets 53, 54, wherein the outlet 54 is connected with a safety valve 6; the outlet 53 is not in use now and thus can be connected with a hose for other purposes, for example, inflating a tire.

Figure 10:
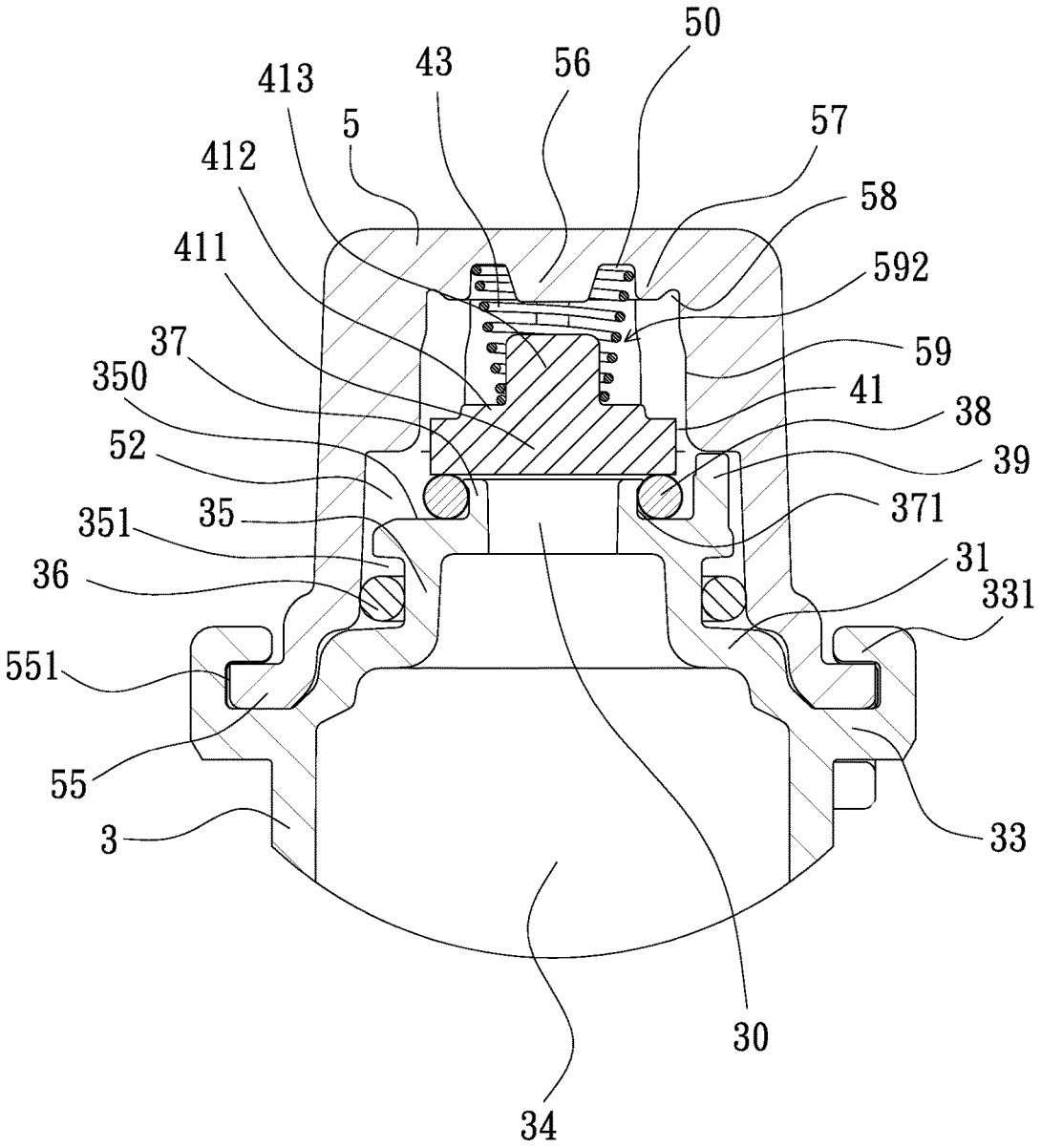
FIG. 10 shows an operational view of the air storage container used in the air compressor of the first embodiment of the present invention, wherein a compression spring of low elasticity is employed.
Figure 11:
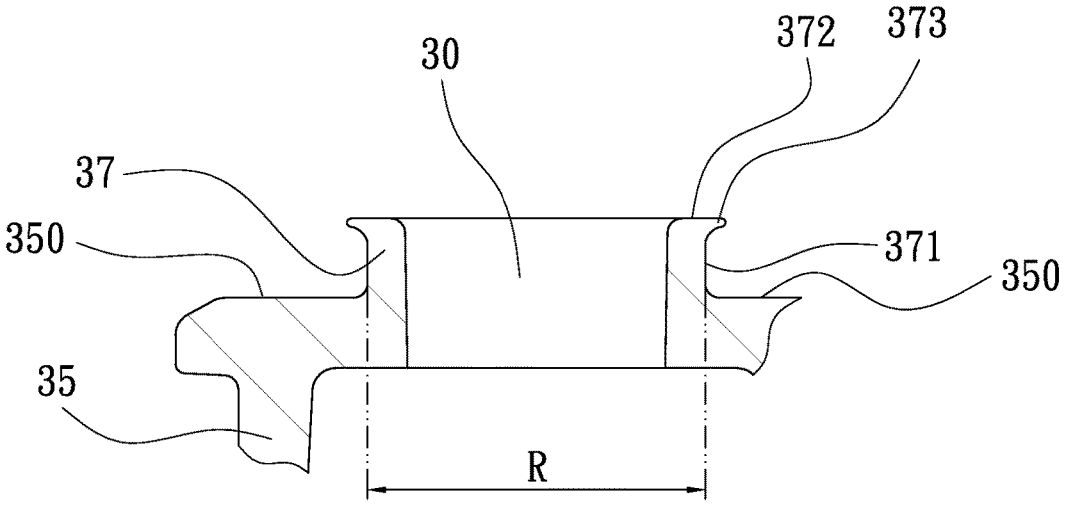
FIG. 11 shows a partially enlarged sectional view of the second tubular projection of the cylinder used in the air compressor.
Figure 12:
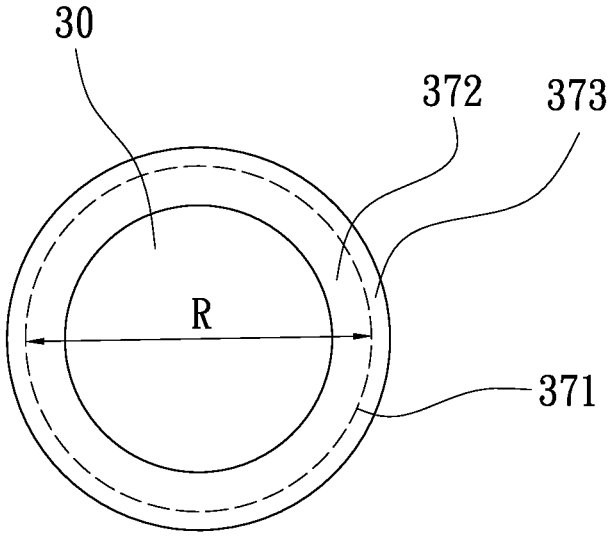
FIG. 12 shows a top view of the second tubular projection of the cylinder shown in FIG. 11.

The cylinder 3 has a top wall 31 and an open bottom 32. The top wall 31 of the cylinder 3 is formed with a first coupling means 33 that includes two substantially opposite lateral plates 330 extending outwardly from the top wall 31 of the cylinder 3. One side of each lateral plate 330 is formed into a first U-shaped holding portion 331 defining a first recess 332. A first tubular projection portion 35 is formed on the top wall 31 of the cylinder 3. The first tubular projection 35 of the cylinder 3 defines a first annular groove 351 around its circumference to be fitted with a first seal ring 36 (an O-ring). A second tubular projection 37 having a diameter less than the first tubular projection 35 is formed on the first tubular projection 35, wherein a first top annular surface 350 is formed on the first tubular projection 35 around the second tubular projection 37. The second tubular projection 37 is flared at its top, on which a second top annular surface 372 with an outer edge 373 is formed, thus defining a second annular groove (371) between the outer edge 373 and the first top annular surface 350, corresponding to a second seal ring 38 (an O-ring). Therefore, the second seal ring 38 can be snugly fitted in the second annular groove 371. The second seal ring 38 has a cross-section diameter greater than the distance between the outer edge 373 and the first top annular surface 350, so that the second seal ring 38 slightly projects above the second top annular surface 372 when it is not subject to a compressive force or when it is subject to a lower level of compressive force from a spring (see FIG. 10). FIGS. 11 and 12 show an enlarged view of the second tubular projection 37, wherein the diameter of the outer edge 373 is greater than the external diameter (R) of the second tubular projection 37. The first tubular projection 35 and the second tubular projection 37 defines a bore 30 that communicates the inner space 34 of the cylinder 3 with the inner space 52 of the air storage container 5, so that the compressed air within the inner space 34 of the cylinder 3 can flow into the inner space 52 of the air storage container 5.

Figure 6:
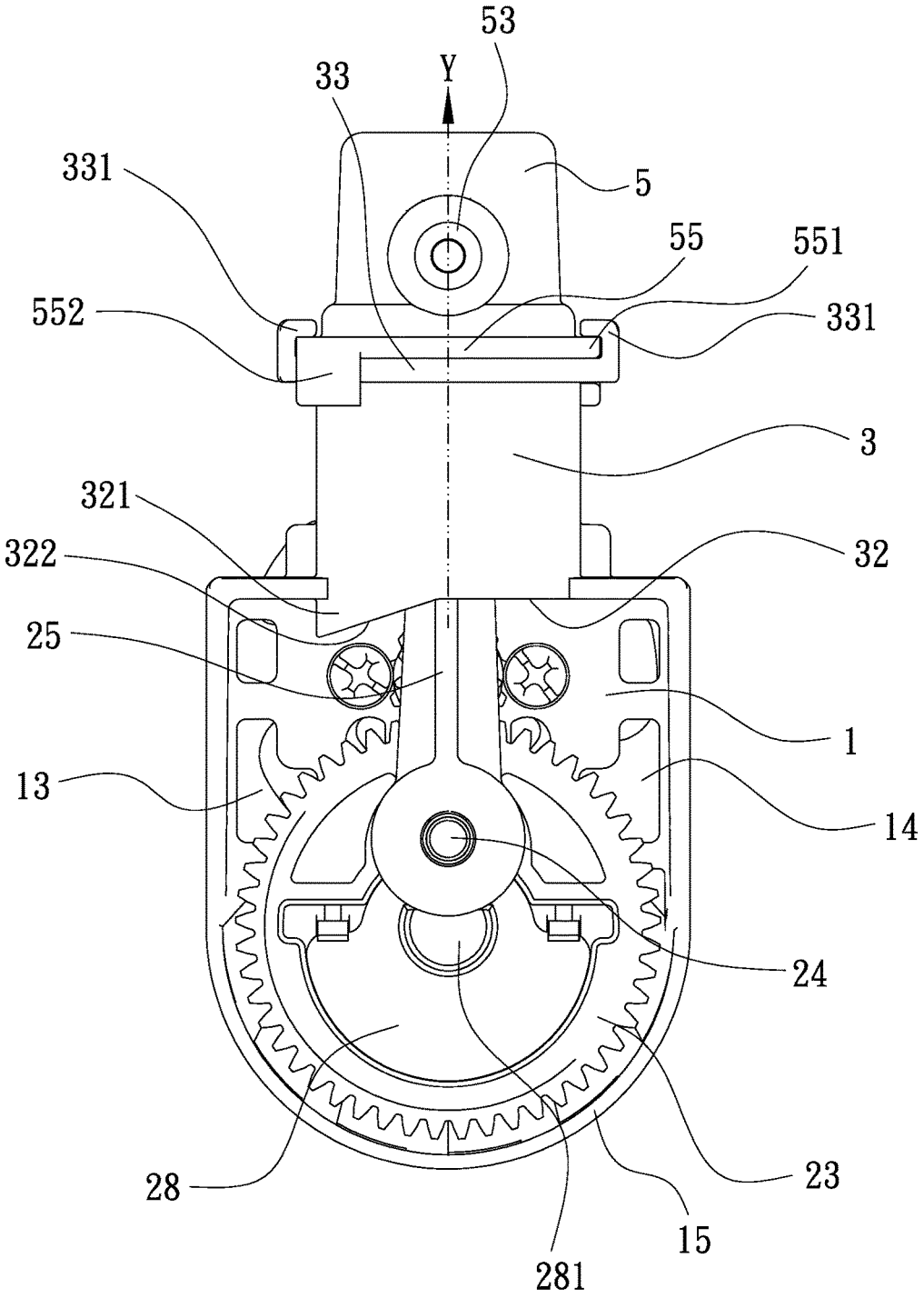
FIG. 6 shows a front view of the air compressor of the first embodiment of the present invention.
Figure 7:
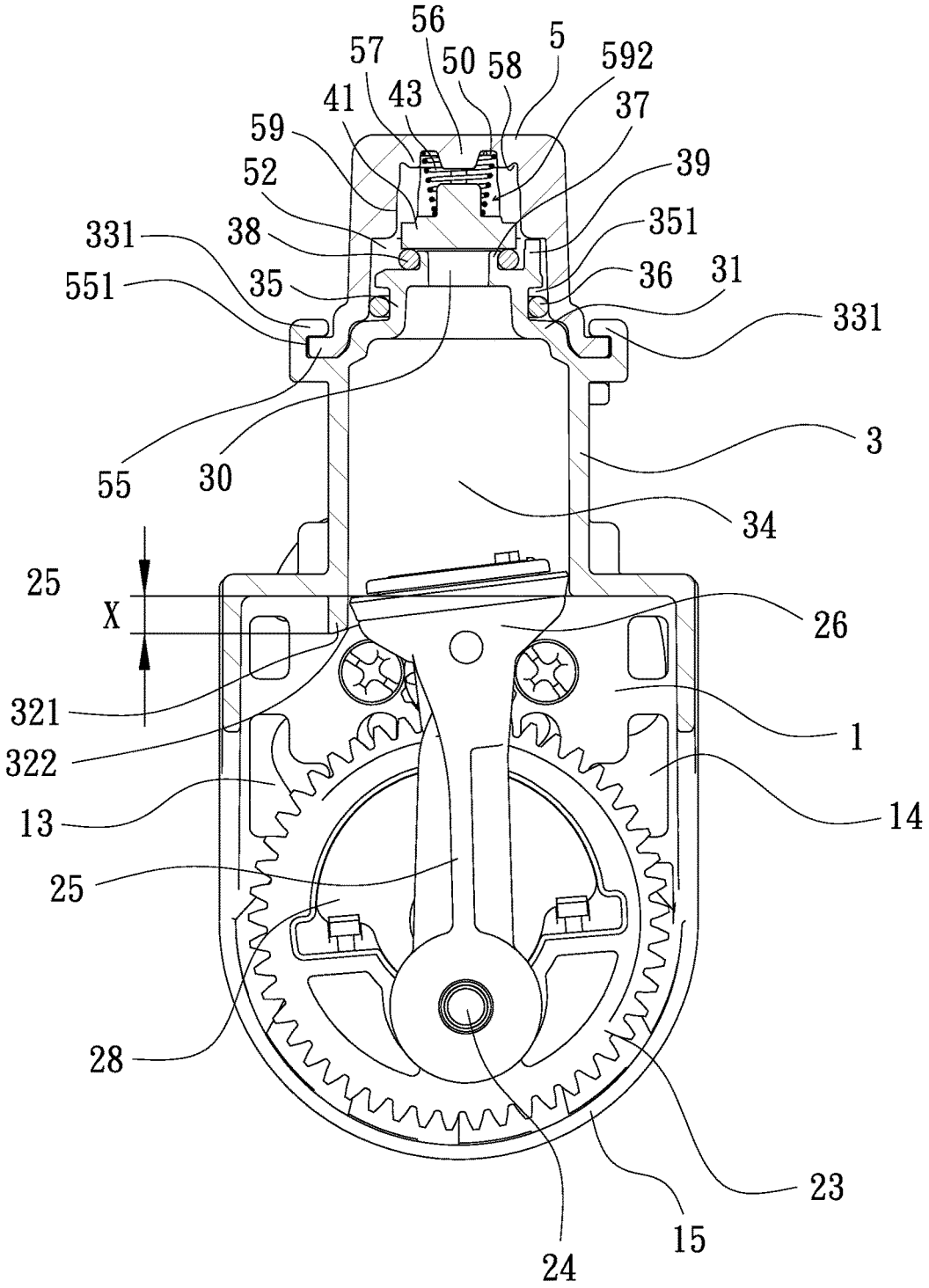
FIG. 7 shows a sectional view of the air compressor of the first embodiment of the present invention.
Figure 8:
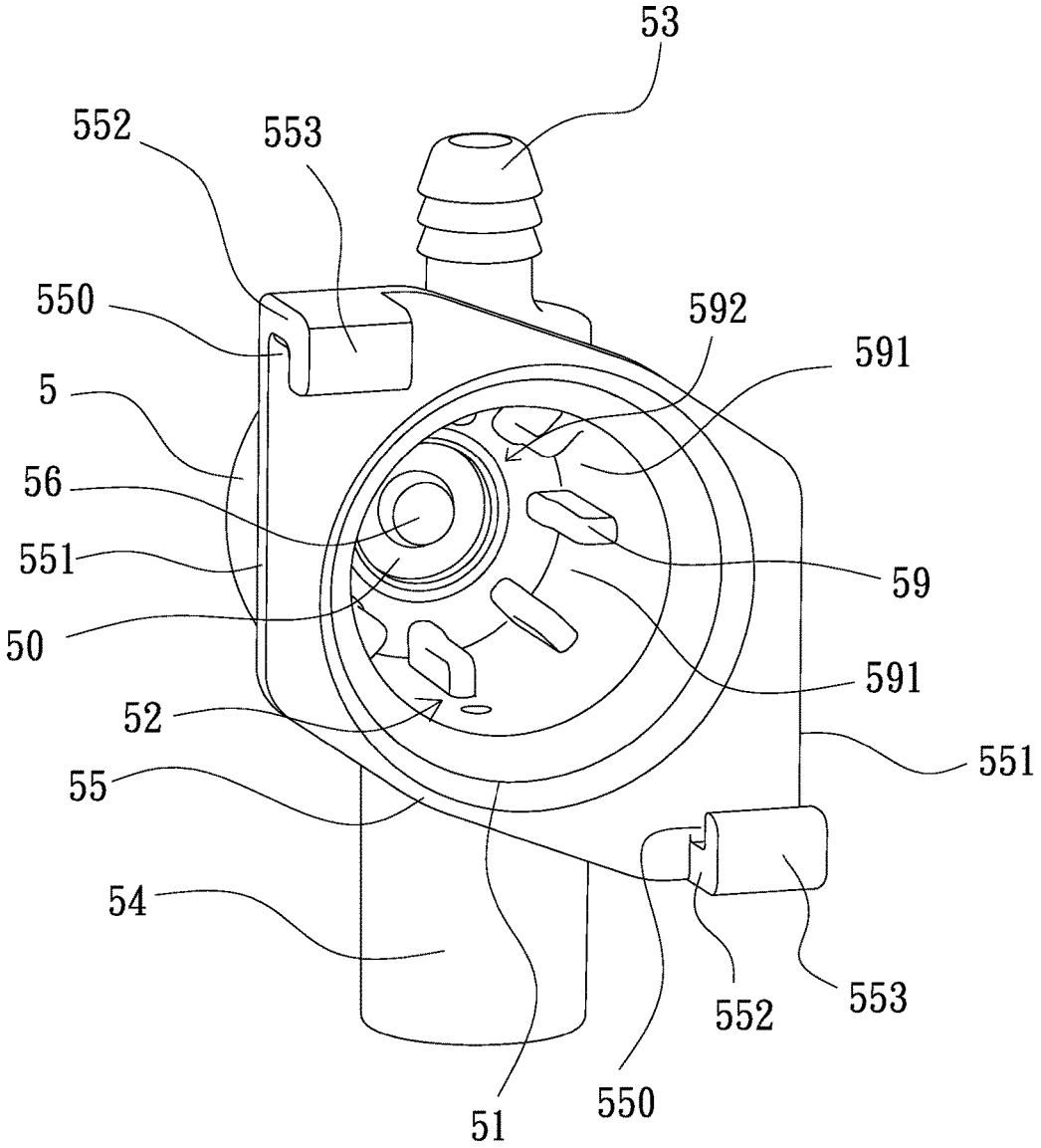
FIG. 8 shows a 3-dimensional view of an air storage container used in the air compressor of the first embodiment of the present invention.
Figure 9:
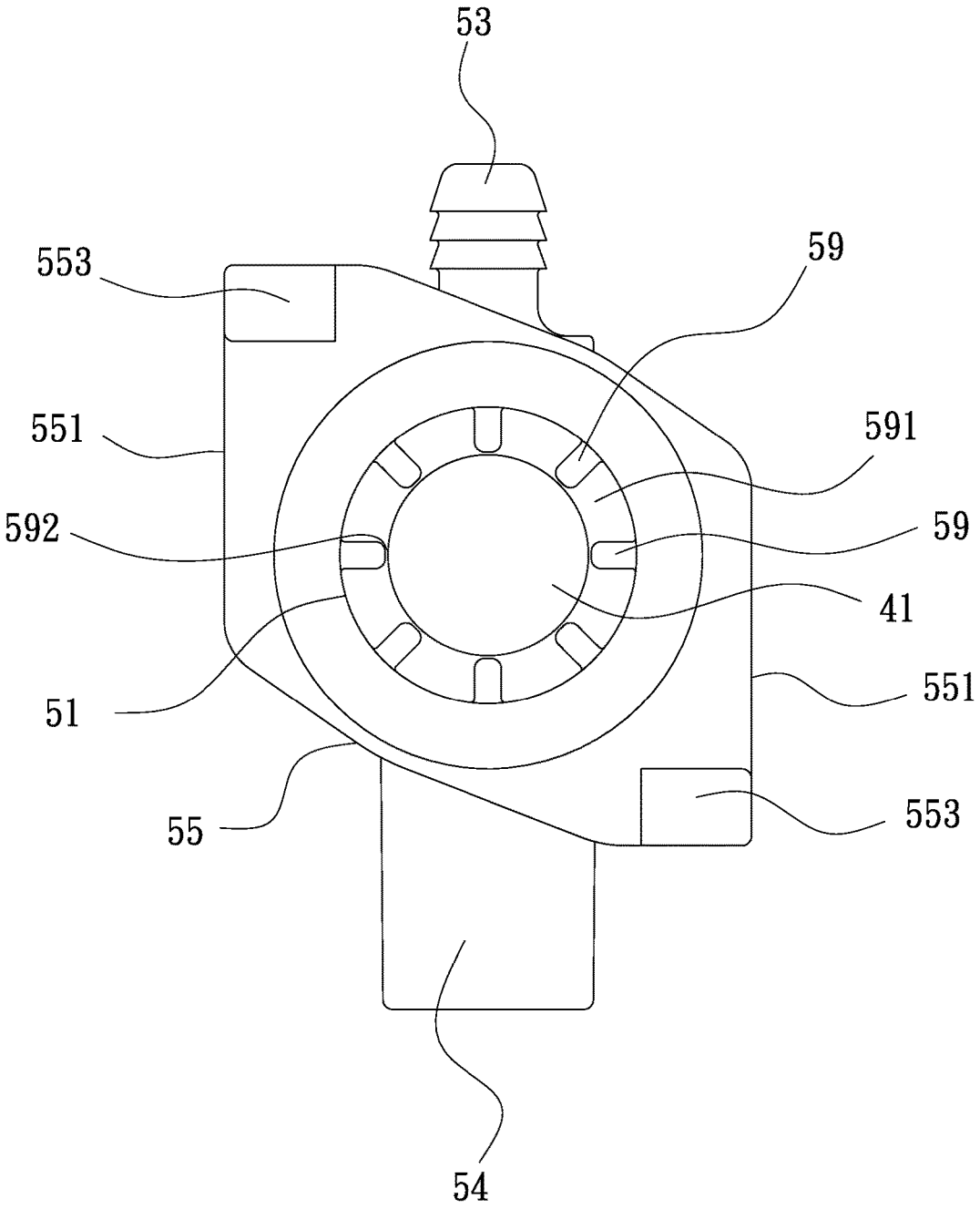
FIG. 9 shows a plan view of the air storage container used in the air compressor of the first embodiment of the present invention, wherein the valve plug is disposed in the central space surrounded by a plurality of ribs.

Referring to FIG. 6 through 10, the open bottom 32 of the cylinder 3 is divided into two halves according to a central vertical line (Y) of the cylinder 3, wherein one half of the open bottom 32 is horizontal while the other half of the open bottom 32 is slanted and parallel to the top surface of the piston head 26 when the piston body 25 is at BDC. As shown, an extension portion 321 of the surrounding wall of the cylinder 3, with a slanted bottom 322, is formed. As shown in FIG. 7, the distance between the lowest point of the slanted bottom 322 and the horizontal bottom is indicated by the symbol (X).

The second annular groove 371 of the second tubular projection 37 can only be formed by plastic molding, so that the second tubular projection 37 cannot be made from metal.

Figure 15:
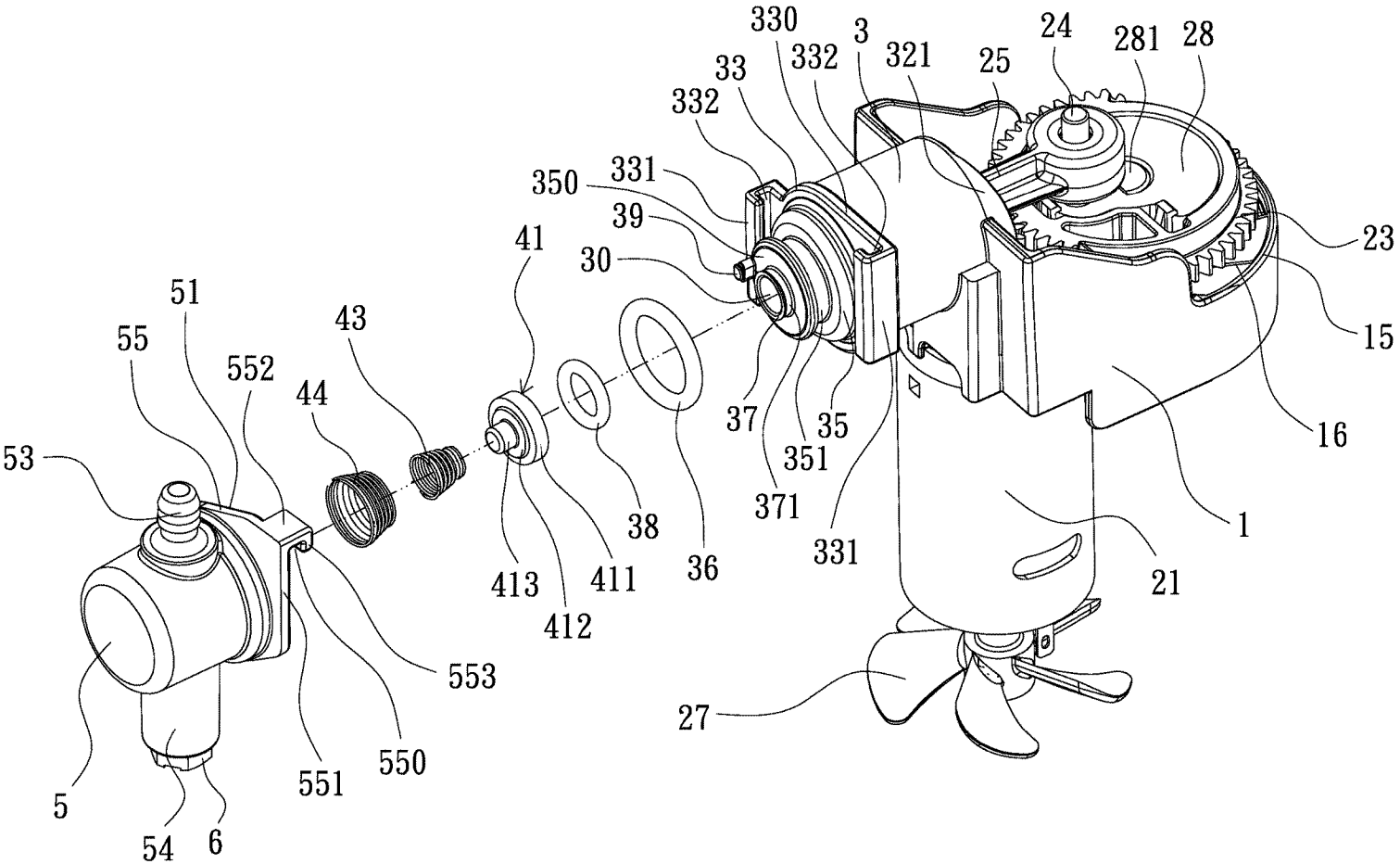
FIG. 15 shows an exploded view of an air compressor according to a second embodiment of the present invention, wherein two compression springs are employed to force the valve plug.
Figure 16:
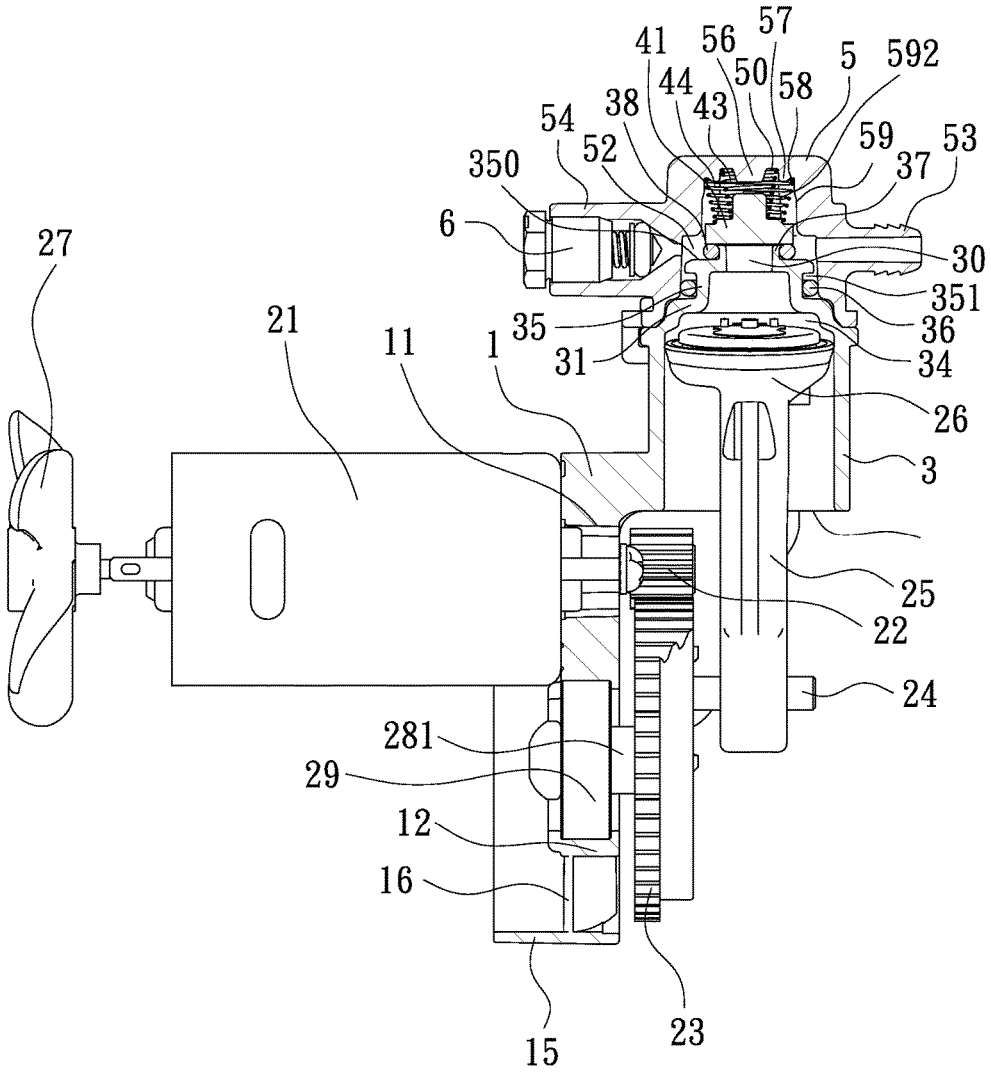
FIG. 16 shows a sectional view of the air compressor of the second embodiment of the present invention.
Figure 17:
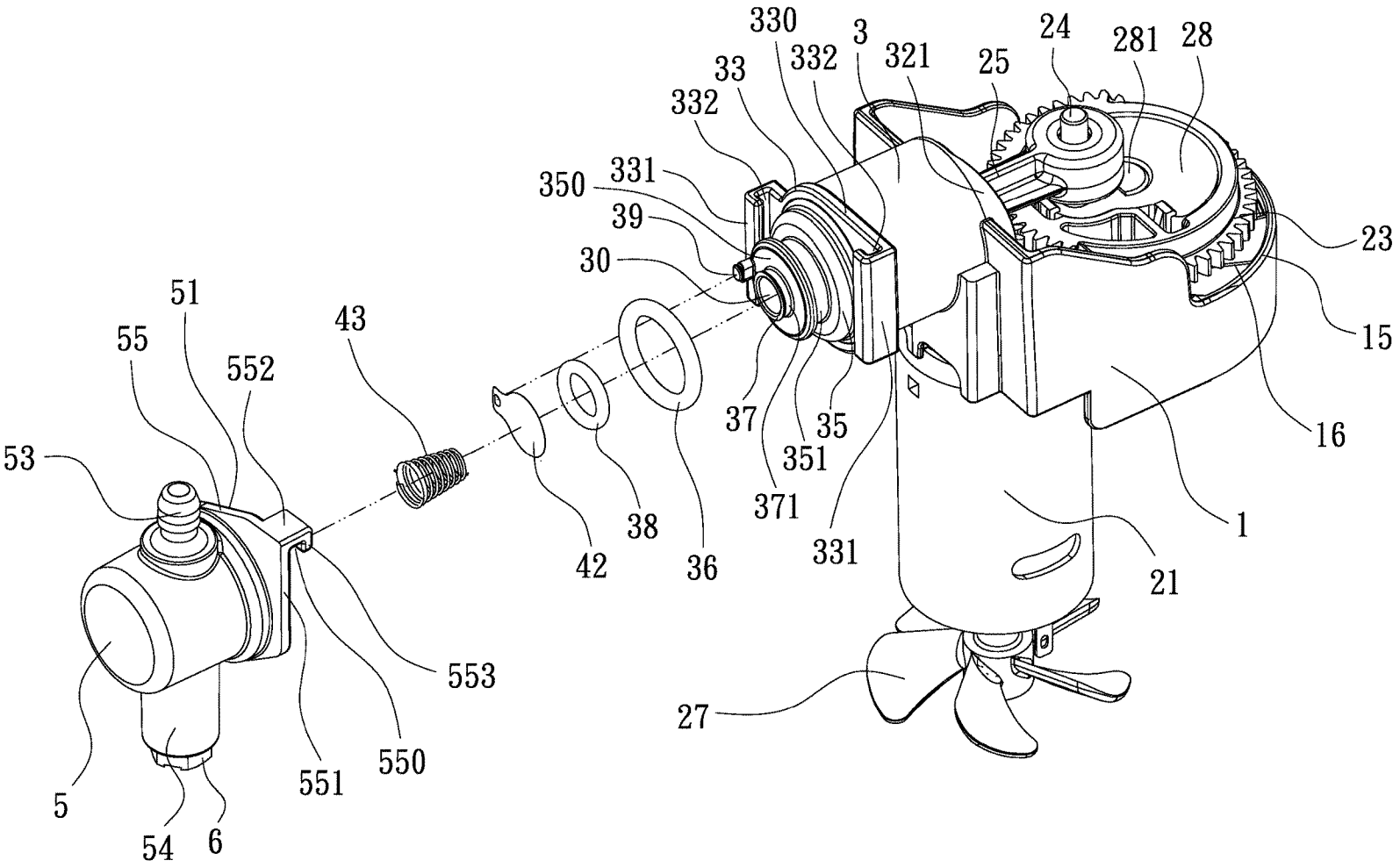
FIG. 17 shows an exploded view of an air compressor according to a third embodiment of the present invention, wherein a resilient sheet is used as a sealing means.
Figure 18:
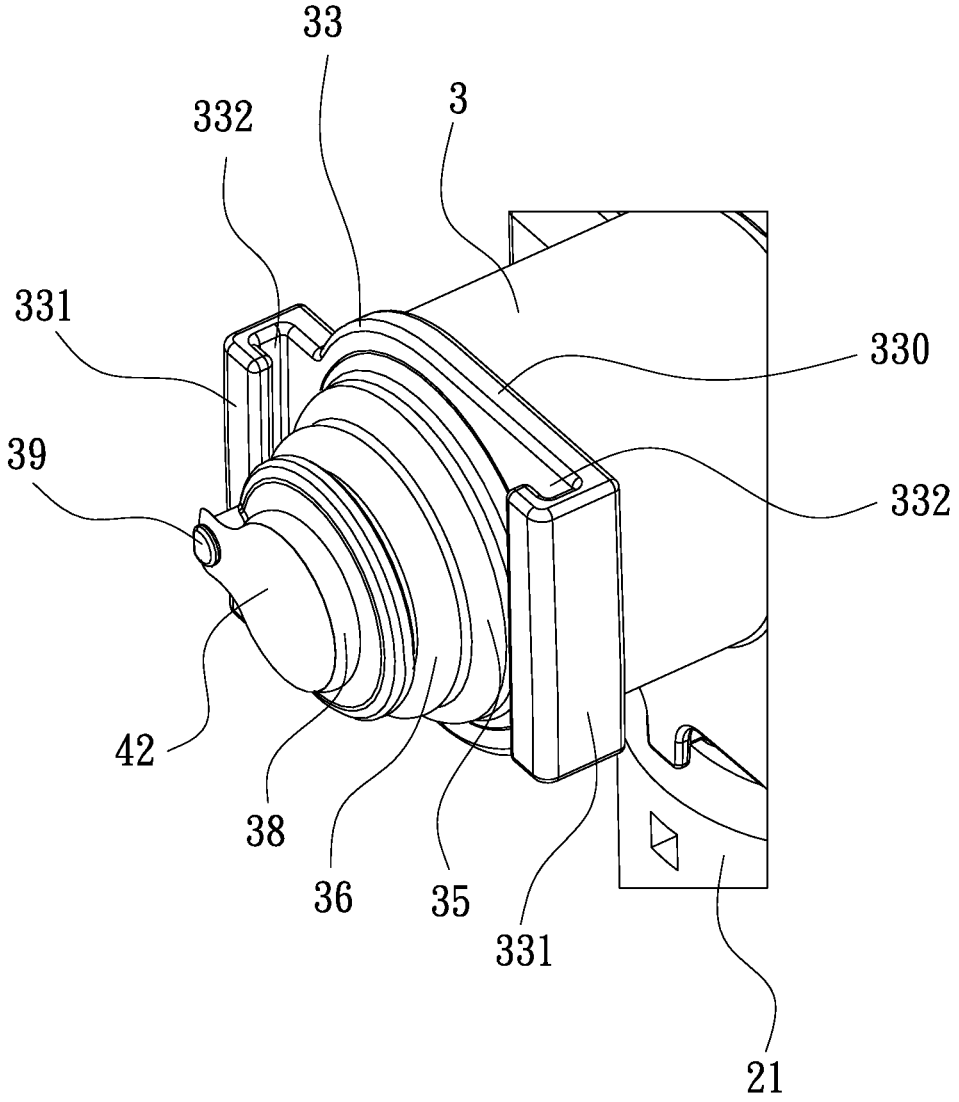
FIG. 18 shows an enlarged view of the resilient sheet used in the air compressor of the third embodiment of the present invention.

The air storage container 5 has an open bottom 51 and defines therein an inner space 52. The open bottom 51 of the air storage container 5 is formed with a second coupling means 55 that includes two substantially opposite lateral plates 551 extending outwardly from the surrounding wall of the air storage container 5. One side of each lateral plate 551 of the air storage container 5 is formed with a second holding portion that includes a base section 552 perpendicular to the associated lateral plate and an end section 553 parallel to the associated lateral plate to define a second recess 550 therebetween (see also FIG. 8). The air storage container 5 is provided at its peripheral inner surface with a plurality of spaced-apart ribs 59. There is a gap 591 existed between two adjacent ribs 59. Furthermore, the air storage container 5 is provided at its top inner surface with a central column 56 and an annular protrusion 57 around the central boss 56, thus defining a first annular groove 50 between the central column 56 and the annular protrusion 57 and defining a second annular groove 58 between the annular protrusion 57 and the ribs 59. The first and second annular grooves 50, 58 can receive springs of different dimensions. As shown in FIG. 10, a compression spring 43 is disposed between the central column 56 and the valve plug 41 placed on the second tubular projection 37, wherein one end of the spring 43 is fitted around the central column 56 and received in the first annular groove 50 of the air storage container 5. FIGS. 15 and 16 show a second embodiment of the present invention, wherein a compression spring 44, which has a dimension greater than the compression spring 43, is fitted around the annular protrusion 57 and received in the second annular groove 58.

The valve plug 41, which is provided for sealing the bore 30 that communicates the inner space 52 of the air storage container 5 with the inner space 34 of the cylinder 3, has three coaxial round portions including a bottom round portion 411, a middle round portion 412, and a top round portion 413, wherein the bottom round portion 411 has a diameter greater than the middle round portion 412, and the middle round portion 412 has a diameter greater than the top round portion 413. The valve plug 41 is located in a central space 592 surrounded by the ribs 59 so that the valve plug 41 is confined by the ribs 59 to prevent it from lateral movement under a force. The diameter of the bottom round portion 411 of the valve plug 41 is smaller than the diameter of the central space 592 surrounded by the ribs 59 but greater than the diameter of the bore 30 defined by the first and second tubular projections 35, 37 (see also FIG. 9). The other end of the compression spring 43 is fitted around the top round portion 413 of the valve plug 41 while urged against the middle round portion 412. The compressed air within the inner space 34 of the cylinder 3 can be controlled at a predetermined pressure to enter the inner space 52 of the air storage container 5 by way of the bore 30 defined by the first and second tubular projections 35, 37 and the gaps 591 between the ribs 59.

Figure 3:
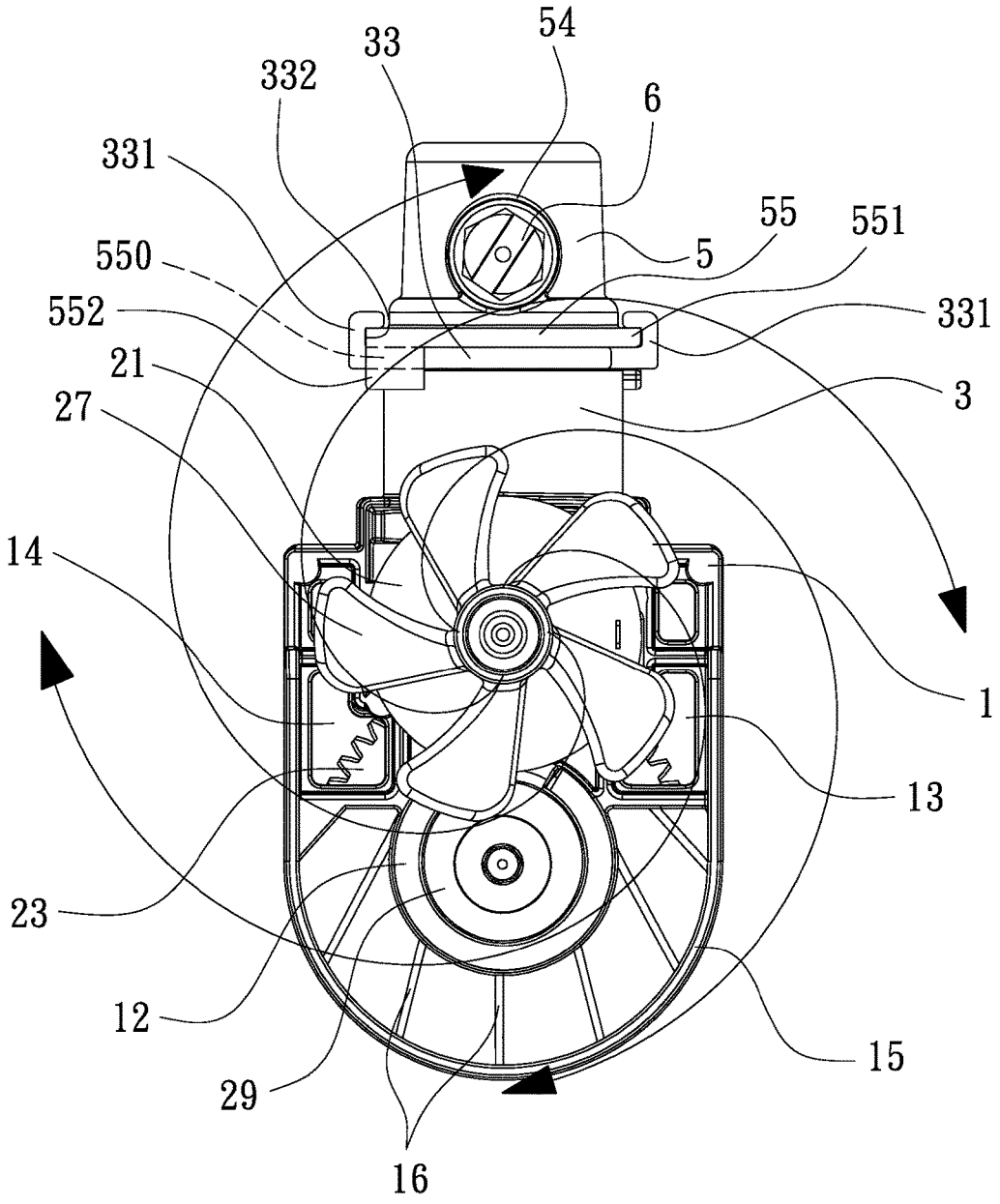
FIG. 3 shows a plan view of the air compressor of the first embodiment of the present invention.
Figure 4:
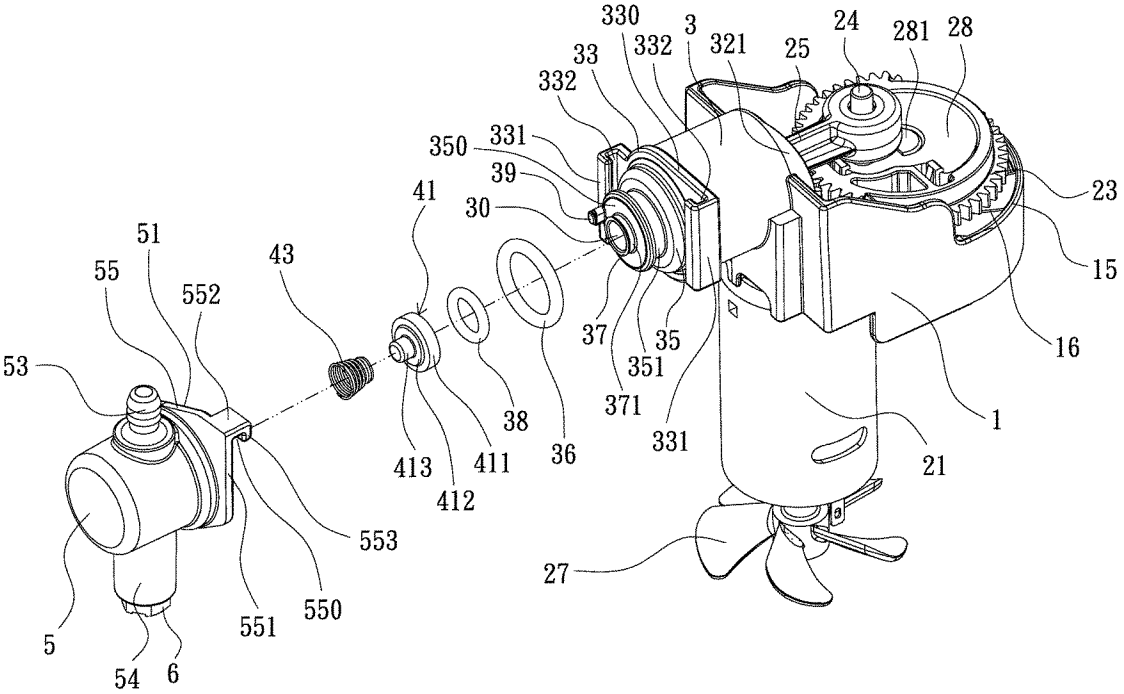
FIG. 4 shows an exploded view of the air compressor of the first embodiment of the present invention, wherein a valve plug is used as a sealing means.

In assembling the cover 5 to the cylinder 3, as shown in FIGS. 3, 4 and 6, the air storage container 5 can be fitted over the first and second tubular projections 35, 37 and be rotated about the cylinder 3 to have its lateral plates 551 to slide in the first recesses 332 of the cylinder 3 and have the lateral plates 330 of the cylinder 3 slide in the second recesses 550 of the air storage container 5, so that the first U-shaped holding portions 331 of the cylinder 3 and the base sections 552 of the second holding portions of the air storage container 5 are mutually blocked and thus the air storage container 5 is detachably mounted to the cylinder 3.

Figure 5:
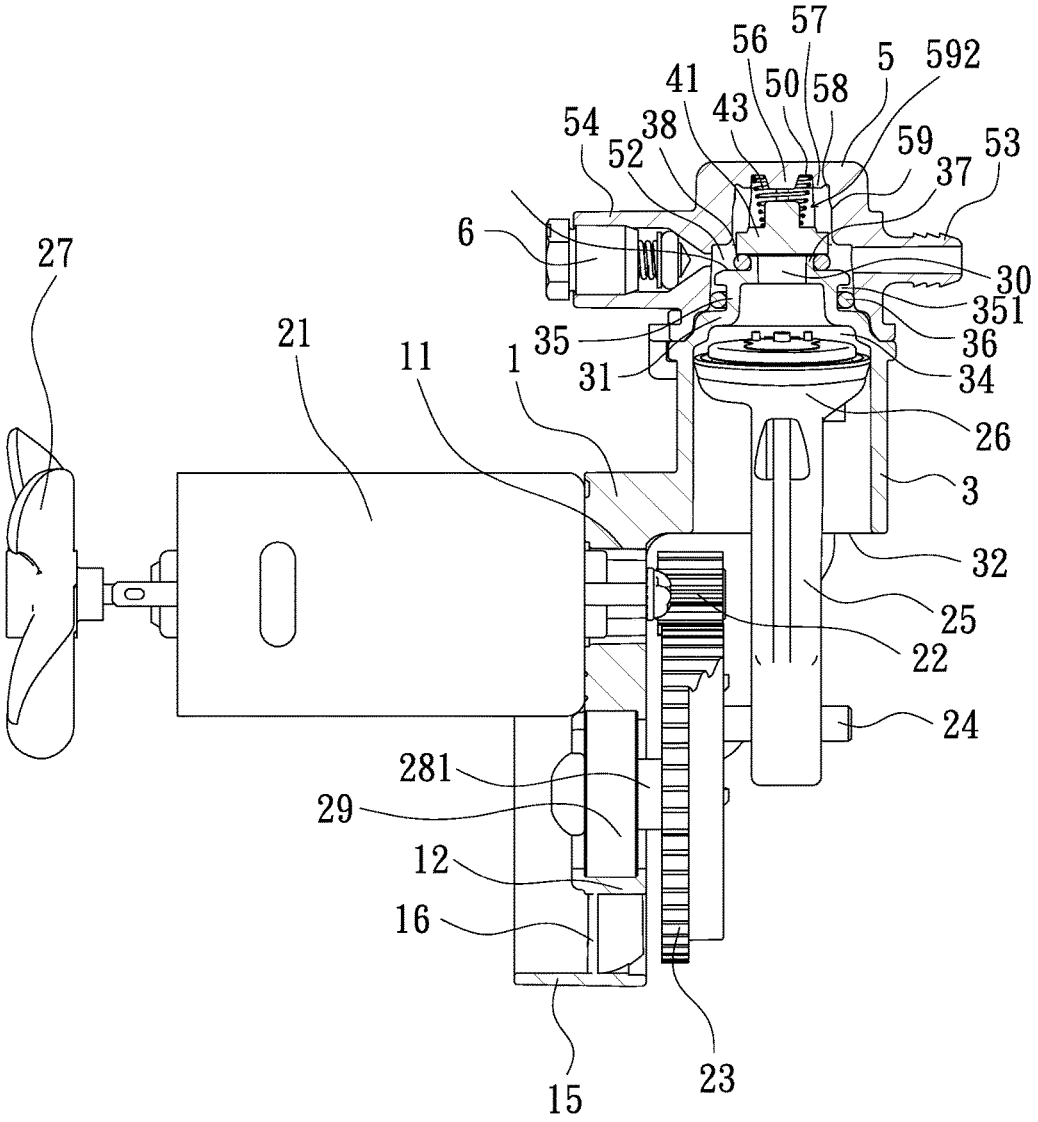
FIG. 5 shows a sectional view of the air compressor of the first embodiment of the present invention.
Figure 14:
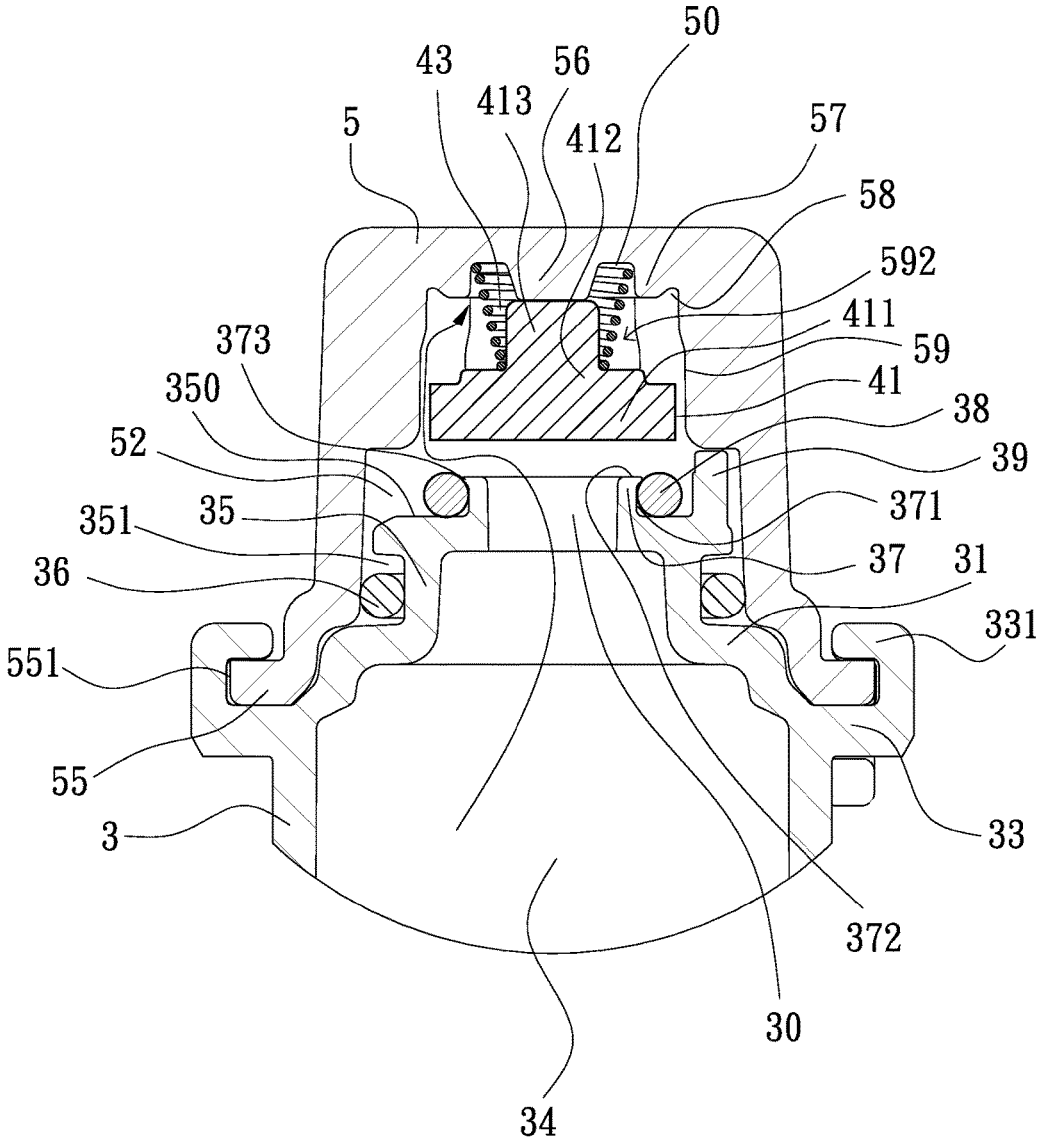
FIG. 14 shows an operational view of the air storage container used in the air compressor of the first embodiment of the present invention, wherein the valve plug is moved up by the compressed air from the cylinder.

The piston body 25 can conduct reciprocating motion within the cylinder 3. FIG. 5 shows an upward motion of the piston body 25, which allows the compressed air within the inner space 34 of the cylinder 3 to overcome the biasing force of the compression spring 43 and thus the valve plug 41 can be forced to move up, so that the compressed air can flow through the bore 30 defined by the first and second tubular projections 35, 37 and the gaps 591 between the ribs 59 to enter the inner space 52 of the air storage container 5 (see FIG. 14). By using a hose connected between the outlet 53 of the air storage container 5 and an application object to be inflated (such as a tire), the compressed air can be delivered to the application object. In FIG. 7, the piston body 25 is at BDC (bottom dead center) and ready for conducting an upward motion (compression stroke). At this moment, the top surface of the piston head 26 is parallel to the slanted bottom 322 of the cylinder 3, and the piston head 26 is entirely within the open bottom 32 of the cylinder 3, so that the piston head 26 will not escape from the cylinder 3, so that the operational security can be increased and the piston head 26 can be moved more smoothly.

Figure 13:
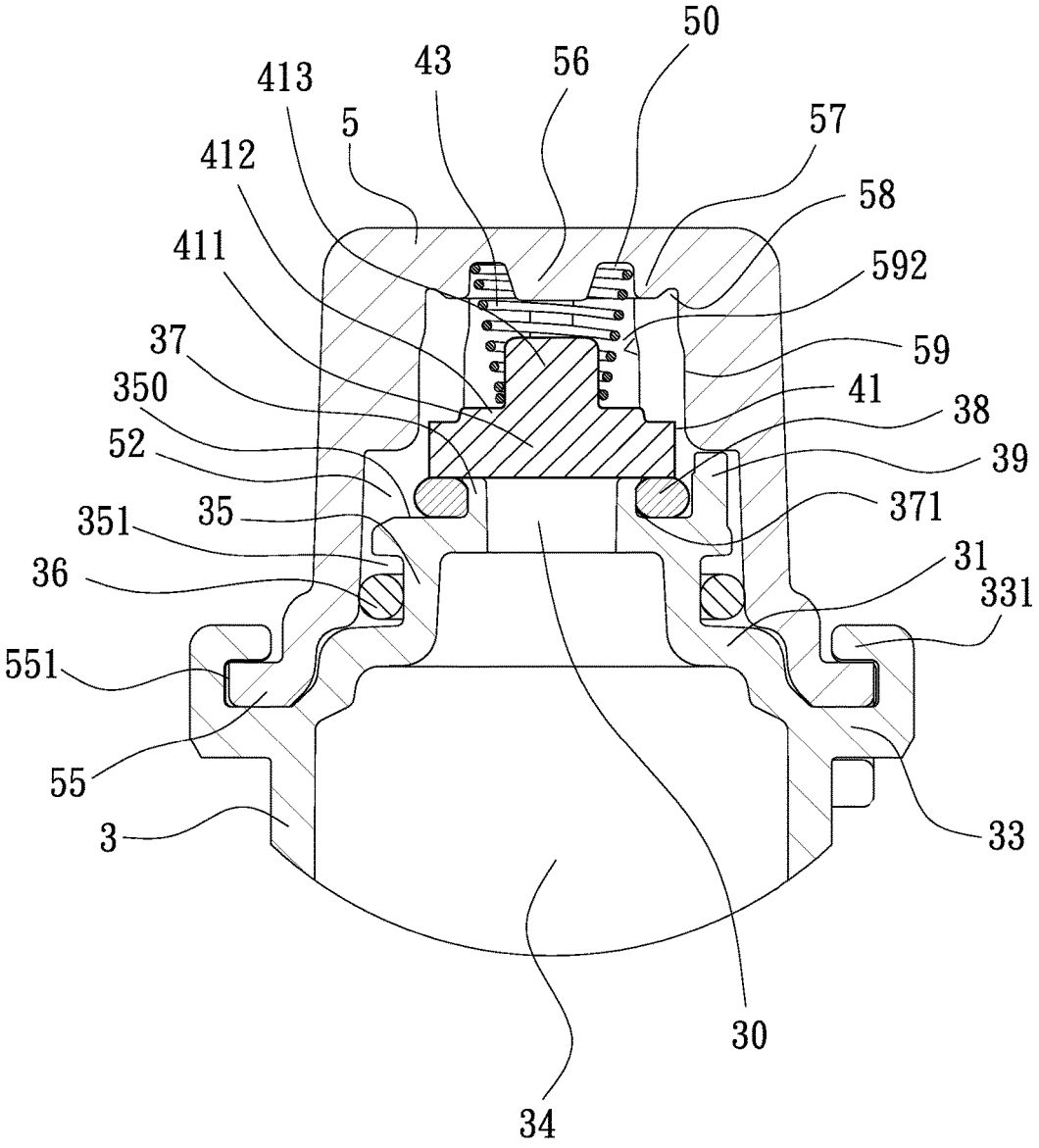
FIG. 13 shows an operational view of the air storage container used in the air compressor of the first embodiment of the present invention, wherein a compression spring of high elasticity is employed.

When the air compressor is not in use, the compression spring 43 can force the valve plug 41 to seal the bore 30 defined by the first and second tubular projections 35, 37. If the compression spring 43 is selected to have a low level of elasticity, the spring can force the valve plug 41 against the second seal ring 38 fitted in the second annular groove 371 of the second tubular projection 37, and thus the valve plug 41 is in sealing engagement with the second seal ring 38, thereby sealing the bore 30 defined by the first and second tubular projections 35, 37 (see FIG. 10). If the compression spring 43 is selected to have a high level of elasticity, the spring can force the valve plug 41 against the second seal ring 38 fitted in the second annular groove 371 of the second tubular projection 37 and the second top annular surface 372 of the second tubular projection 37 (see FIG. 13), so that the bore 30 defined the first and second tubular projections 35, 37 can be sealed more securely.

Figure 19:
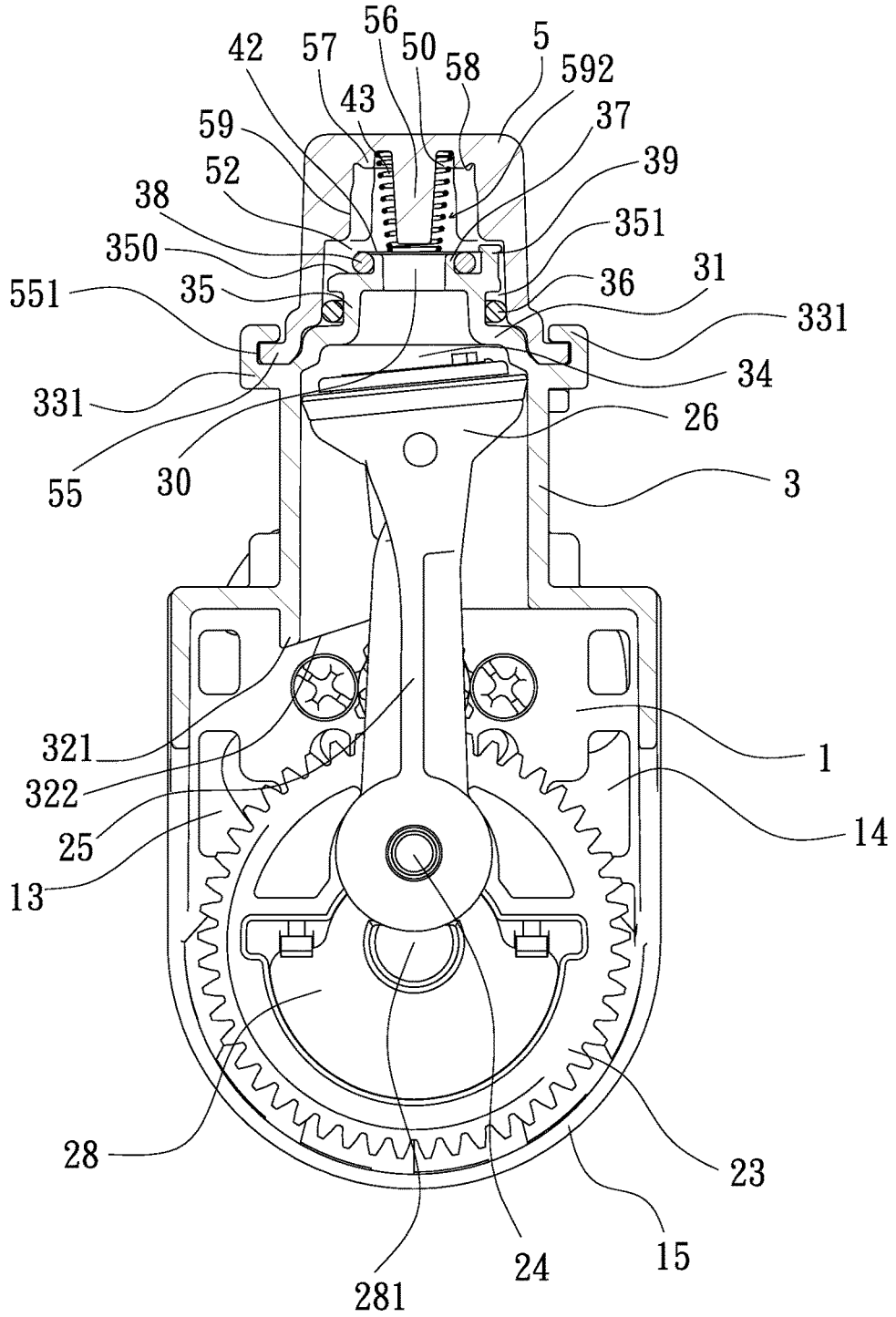
FIG. 19 shows a sectional view of the air compressor of the third embodiment of the present invention.
Figure 20:
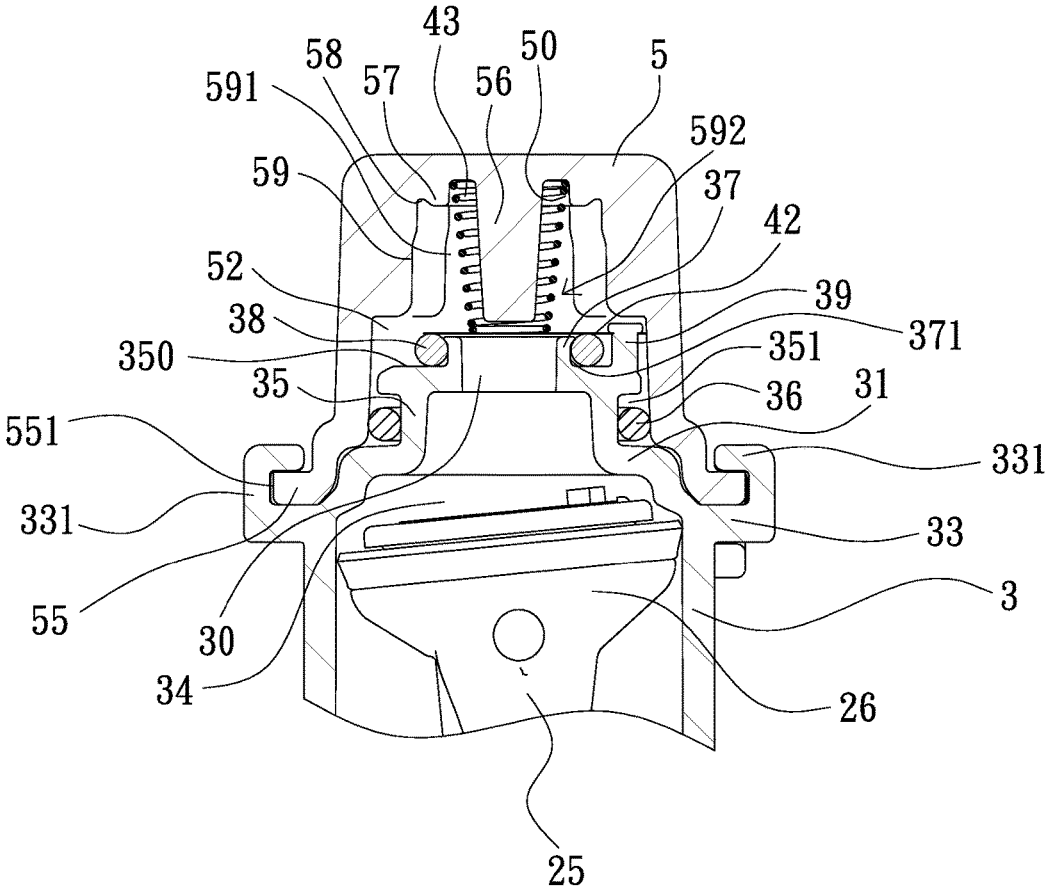
FIG. 20 shows a partially enlarged sectional view of the air compressor of the third embodiment of the present invention.
Figure 21:
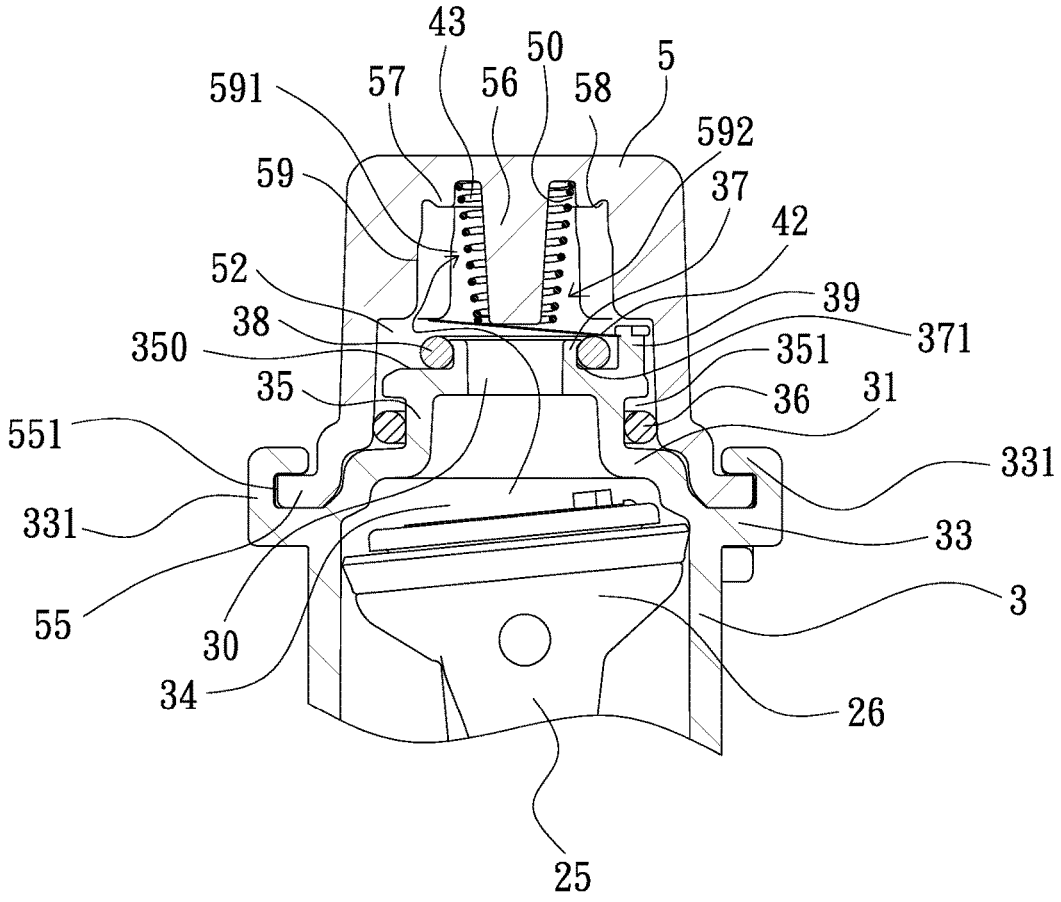
FIG. 21 shows an operational view of the air compressor of the third embodiment of the present invention, wherein the resilient sheet is moved up by the compressed air from the cylinder.
Figure 22:
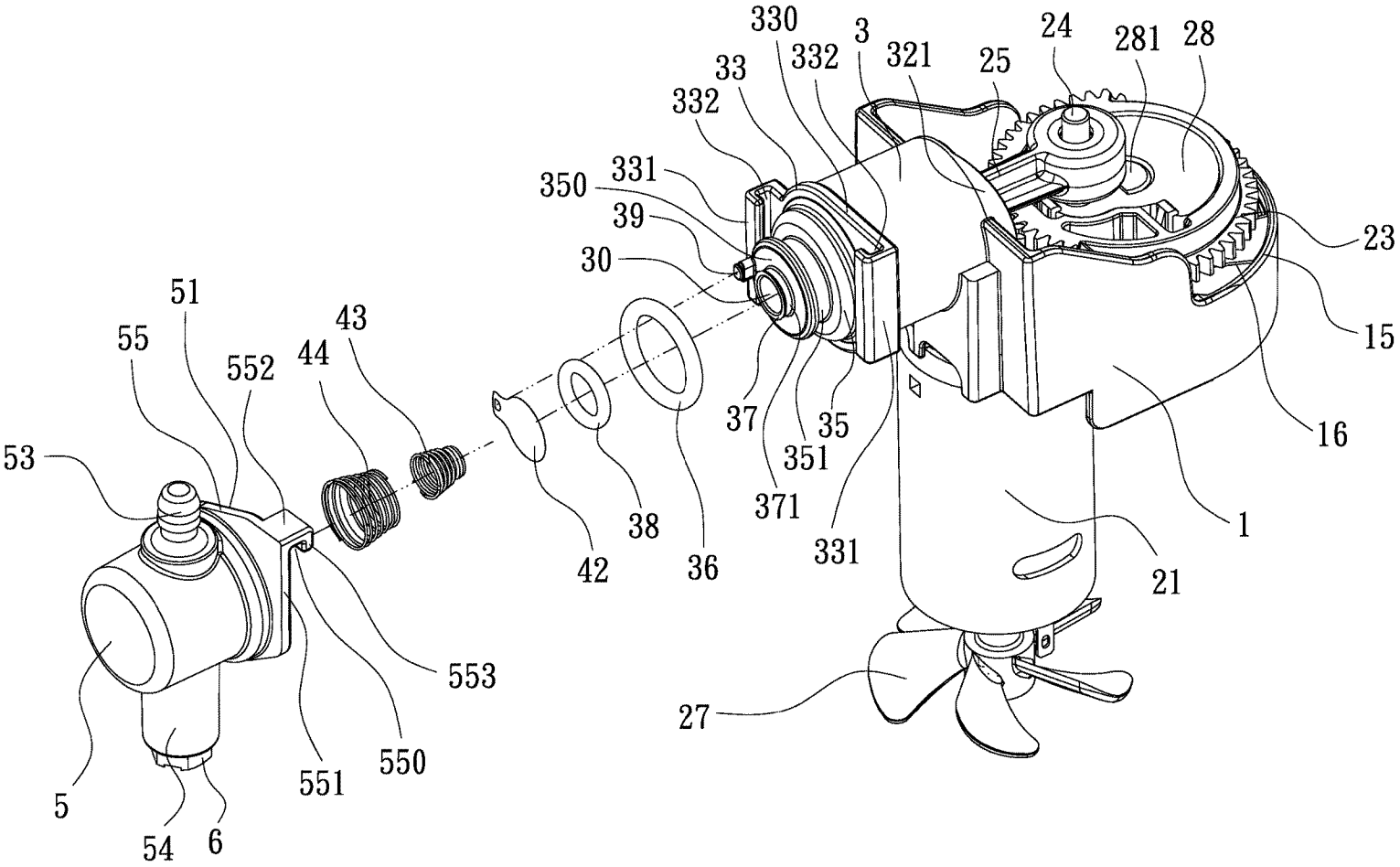
FIG. 22 shows an exploded view of an air compressor according to a fourth embodiment of the present invention, wherein two compression springs are employed to force the resilient sheet.
Figure 23:
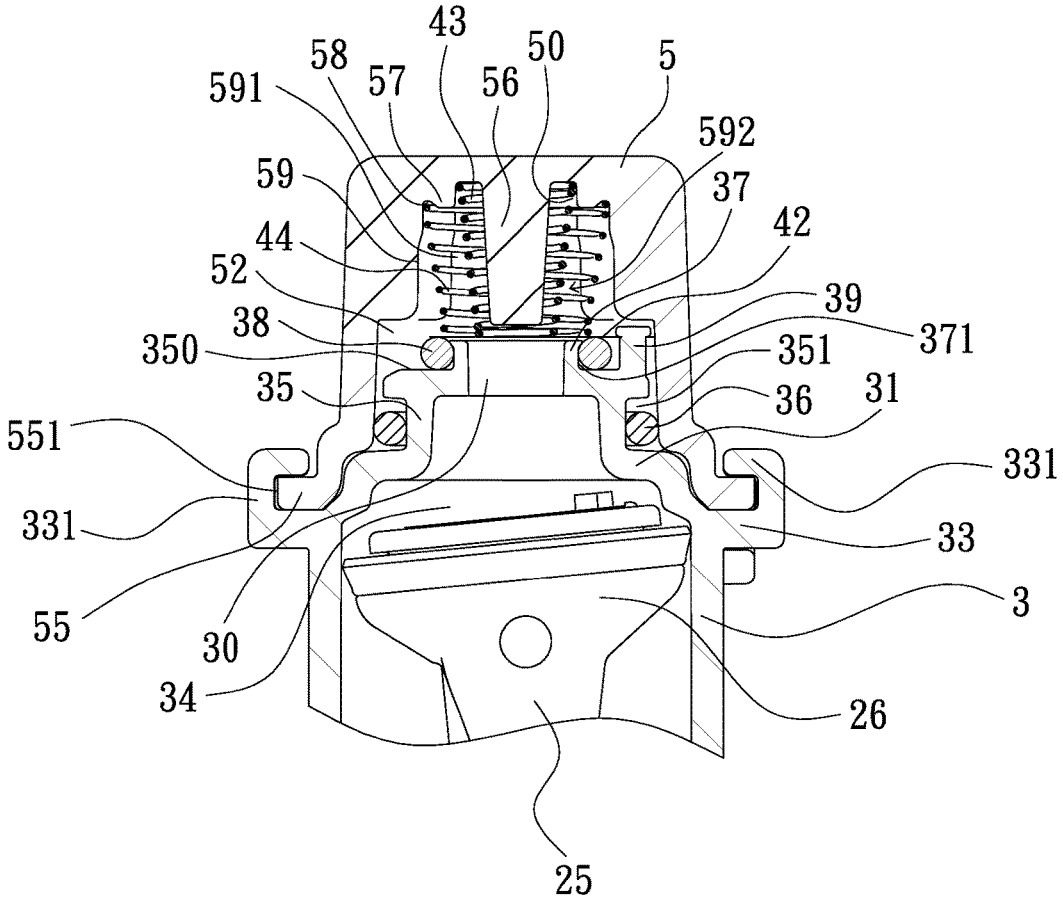
FIG. 23 shows a partially enlarged sectional view of the air compressor of the fourth embodiment of the present invention.
Figure 24:
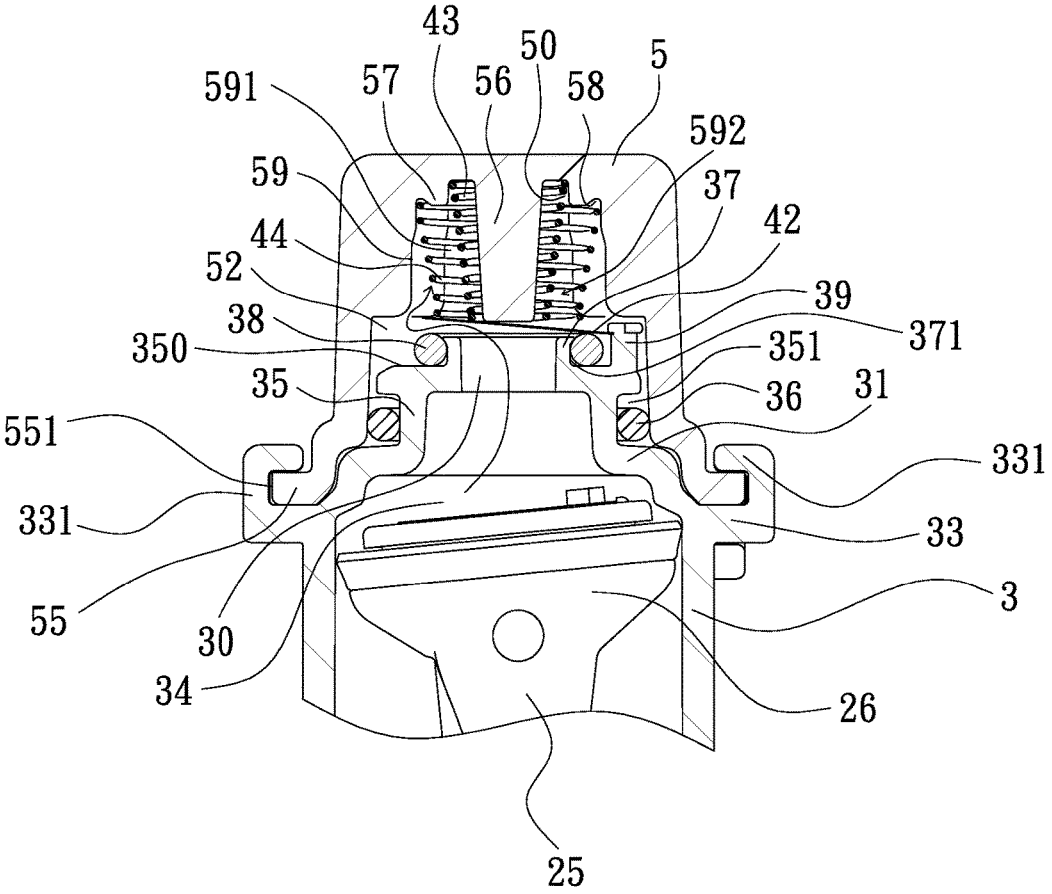
FIG. 24 shows a partially enlarged sectional view of the air compressor of the fourth embodiment of the present invention, wherein the resilient sheet is moved up by the compressed air from the cylinder.

FIGS. 17 through 21 show a third embodiment of the present invention, wherein a resilient sheet 42 is used as a sealing means. Similarly, in this embodiment, a first tubular projection portion 35 is formed on the top wall 31 of the cylinder 3. The first tubular projection 35 of the cylinder 3 defines a first annular groove 351 around its circumference to be fitted with a first seal ring 36 (an O-ring). A second tubular projection 37 having a diameter less than the first tubular projection 35 is formed on the first tubular projection 35, wherein a first top annular surface 350 is formed on the first tubular projection 35 around the second tubular projection 37. The second tubular projection 37 is flared at its top, on which a second top annular surface 372 with an outer edge 373 is formed, thus defining a second annular groove 371 between the outer edge 373 and the first top annular surface 350 to be snugly fitted with a second seal ring 38 (an O-ring). The second seal ring 38 has a cross-section diameter greater than the distance between the outer edge 373 and the first top annular surface 350, so that the second seal ring 38 slightly projects above the second top annular surface 372 when it is not subject to a compressive force or when it is subject to a lower level of compressive force from a spring. The first tubular projection 35 and the second tubular projection 37 defines a bore 30 that communicates the inner space 34 of the cylinder 3 with the inner space 52 of the air storage container 5, so that the compressed air within the inner space 34 of the cylinder 3 can flow into the inner space 52 of the air storage container 5. The first annular flat surface 350 of the first tubular projection 35 is provided with a post 39 that fixes one end of the resilient sheet 42 on the second tubular projection 37. The central column 56, which has a greater length than those of the previous embodiments, extends downwardly to approach the resilient sheet 42 so that upward movement of the resilient sheet 42 can be limited by the central column 56 when the air pressure within the cylinder 3 exceeds a predetermined pressure (see FIGS. 20 and 21). Furthermore, the air storage container 5 is provided at its top inner surface with a central column 56 and an annular protrusion 57 around the central boss 56, thus defining a first annular groove 50 between the central column 56 and the annular protrusion 57 and defining a second annular groove 58 between the annular protrusion 57 and the ribs 59. The first and second annular grooves 50, 58 can receive springs of different dimensions. As shown in FIGS. 19 and 20, the compression spring 43 is disposed between the central column 56 and the resilient sheet 42, wherein one end of the compression spring 43 is fitted around the central column 56 and received in the first annular groove 50 of the air storage container 5, the other end of the compression spring 43 is urged against the resilient sheet 42. FIGS. 22 through 24 show a fourth embodiment of the present invention, wherein a compression spring 44, which has a dimension greater than the compression spring 43, is fitted around the annular protrusion 57 and received in the second annular groove 58.

As a summary, one primary feature of the present invention is that the cylinder 3 and the main frame 1 are integrally formed of plastic, which can reduce the manufacturing cost. A second feature of the present invention is that the air storage container 5 and the cylinder 3 are detachably assembled. A third feature of the present invention is that the main frame 1 is provided with two through holes 13, 14 for guiding the air flow, generated by the cooling fan 27, to flow through the main frame 1. A fourth feature of the present invention is that the main frame 1 is formed with two lateral walls and a bottom wall to form a U-shaped wind collecting shell 15, wherein the second portion 12 of the main frame 1 is held by multiple radial braces 16, which facilitates the air flow being introduced through the main frame 1 for rapidly dissipating the heat of the bearing 29 generated from the reciprocating motion of the piston body 25 within the cylinder 3, thereby increasing the operational security.

I claim:

1. An air compressor including a main frame, a cylinder fitted with a piston body having a piston head, an air storage container communicating with the cylinder, and a motor mounted to the main frame for driving the piston body to conduct reciprocating motion within the cylinder so as to force compressed air in an inner space of the cylinder to flow into the air storage container; wherein the improvement comprises: the cylinder and the main frame are integrally formed of plastic, which further includes a large gear and wherein the main frame has a first portion for mounting the motor and a second portion for fixing a bearing in place; the motor is fitted with a small gear and a cooling fan opposite to the small gear, wherein the large gear is mounted to the main frame such that the small gear engages with the large gear, the large gear is provided with a counterweight being fixed with a crankpin, the piston body is pivotally mounted to the crankpin, a crankshaft is fixed at one end to the counterweight and mounted at the other end to the bearing, so that the motor rotates the small gear engaged with the large gear to cause the crankpin to swing in a circle around the crankshaft so as to drive the piston body to conduct reciprocating motion within the cylinder; the main frame defines at least one through hole for guiding the air flow, generated by the cooling fan, to flow through the main frame, and the main frame is formed with two lateral walls and a bottom wall to form a U-shaped wind collecting shell, wherein the second portion is located within the U-shaped wind collecting shell and held by multiple radial braces formed between the second portion and the U-shaped wind collecting shell so as to facilitate the air flow, generated by the cooling fan, being introduced through the main frame for rapidly dissipating the heat generated from the reciprocating motion of the piston body within the cylinder, thereby increasing the operational security.

2. The air compressor of claim 1, wherein the cylinder has a top wall and an open bottom, wherein the top wall of the cylinder is formed with a first coupling means that includes two substantially opposite lateral plates extending outwardly from the top wall of the cylinder, one side of each lateral plate being formed into a first holding portion defining a first recess; the air storage container has an open bottom and defines therein an inner space, wherein the open bottom of the air storage container is formed with a second coupling means that includes two substantially opposite lateral plates extending outwardly from a surrounding wall of the air storage container, one side of each lateral plate of the air storage container being formed with a second holding portion that includes a base section perpendicular to the associated lateral plate and an end section parallel to the associated lateral plate to define a second recess therebetween; whereby the air storage container is capable of being fitted over the cylinder and rotated about the cylinder to have its lateral plates to slide in first recesses of the cylinder and have the lateral plates of the cylinder slide in second recesses of the air storage container, so that first holding portions of the cylinder and base sections of second holding portions of the air storage container are mutually blocked and thus the air storage container is detachably mounted to the cylinder.

3. The air compressor of claim 2, wherein a first tubular projection is formed on the top wall of the cylinder, the first tubular projection of the cylinder defining a first annular groove around its circumference to be fitted with a first seal ring; a second tubular projection having a diameter less than the first tubular projection is formed on the first tubular projection, a first top annular surface being formed on the first tubular projection around the second tubular projection, the second tubular projection being flared at its top, on which a second top annular surface with an outer edge is formed, thus defining a second annular groove between the outer edge and the first top annular surface to be snugly fitted with a second seal ring, the second seal ring having a cross-section diameter greater than the distance between the outer edge and the first top annular surface, so that the second seal ring slightly projects above the second top annular surface when it is not subject to a compressive force or when it is subject to a lower level of compressive force, the first tubular projection and the second tubular projection defining a bore that communicates the inner space of the cylinder with the inner space of the air storage container; the air storage container is provided at its peripheral inner surface with a plurality of spaced-apart ribs, between two adjacent ribs defining a gap, and the air storage container is provided at its top inner surface with a central column and an annular protrusion around the central column, thus defining a first annular groove between the central column and the annular protrusion and defining a second annular groove between the annular protrusion and the ribs; a compression spring is disposed between the top inner surface of the air storage container and a sealing means placed on the second tubular projection, wherein one end of the spring is fitted around the central column and received in the first annular groove of the air storage container.

4. The air compressor of claim 3, wherein the compression spring has sufficient elasticity to force the sealing means against the second seal ring to seal the bore defined by the first and second tubular projections when the air compressor is not in use.

5. The air compressor of claim 4, wherein the open bottom of the cylinder is divided into two halves according to a central vertical line of the cylinder, one half of the open bottom being horizontal while the other half of the open bottom being slanted and parallel to the top surface of the piston head when the piston body is at bottom dead center (BDC), whereby when the piston body is at BDC, the piston head will be entirely within the open bottom of the cylinder and thus will not escape from the cylinder, so that the operational security will be increased and the piston head will be moved more smoothly.

6. The air compressor of claim 4, wherein the compression spring has sufficient elasticity to force the sealing means against the second seal ring and the second annular surface of the second the tubular projection, whereby the bore defined by the first and second tubular projections can be sealed more securely.

7. The air compressor of claim 6, wherein a second compression spring is disposed between the top inner surface of the air storage container and the sealing means, wherein one end of the second compression spring is fitted around the annular protrusion and received in the second annular groove of the air storage container.

8. The air compressor of claim 6, wherein the sealing means is a valve plug, which has three coaxial round portions including a bottom round portion, a middle round portion, and a top round portion, the bottom round portion having a diameter greater than the middle round portion, the middle round portion having a diameter greater than the top round portion, the valve plug being located in a central space surrounded by the ribs so that the valve plug is confined by the ribs to prevent it from lateral movement under a force, the diameter of the bottom round portion of the valve plug being smaller than the diameter of the central space surrounded by the ribs but greater than the diameter of the bore defined by the first and second tubular projections; the other end of the compression spring being fitted around the top round portion of the valve plug while urged against the middle round portion, whereby the compressed air within the inner space of the cylinder will be controlled at a predetermined pressure to enter the inner space of the air storage container by way of the bore defined by the first and second tubular projections and the gaps between the ribs.

9. The air compressor of claim 6, wherein the sealing means is a resilient sheet, the first top annular surface of the first tubular projection is provided with a post that fixes one end of the resilient sheet on the second tubular projection, the central column extends downwardly to approach the resilient sheet so that upward movement of the resilient sheet is limited by the central column when the air pressure within the cylinder exceeds a predetermined pressure, and the compression spring is disposed between the top inner surface of the air storage container and the resilient sheet, wherein one end of the compression spring is fitted around the central column and received in the first annular groove of the air storage container, and the other end of the compression spring is urged against the resilient sheet.

* * * * *